United States Patent [19]

Masuko et al.

[11] 4,272,924

[45] Jun. 16, 1981

[54] METHOD OF ULTRASONIC CONTROL FOR LAPPING AND AN APPARATUS THEREFOR

[75] Inventors: Masami Masuko, Tokyo; Chikanobu Ichikawa, Koshoku, both of Japan

[73] Assignee: Fujikoshi Machinery Corporation, Nagano, Japan

[21] Appl. No.: 116,396

[22] Filed: Jan. 29, 1980

[30] Foreign Application Priority Data

Jan. 31, 1979 [JP] Japan ..... 54-10024

[51] Int. Cl.[3] ..... B24B 49/04

[52] U.S. Cl. ..... 51/165 R; 51/118; 51/131.3; 51/283 R; 73/597

[58] Field of Search ..... 51/165 R, 117, 118, 51/131.2, 131.3, 283 R; 73/597

[56] References Cited

U.S. PATENT DOCUMENTS

| | | | |
|---|---|---|---|
| 3,063,206 | 11/1962 | Meyerhoff | 51/165 R |
| 3,097,458 | 7/1963 | Richmond | 51/165 R |
| 3,579,922 | 5/1971 | Mandonns | 51/165 R |
| 3,994,154 | 11/1976 | Niklas | 73/597 |
| 4,114,455 | 9/1978 | Walker | 73/597 |
| 4,123,943 | 11/1978 | Roddy | 73/597 |
| 4,197,676 | 4/1980 | Sauerland | 51/165 R |

*Primary Examiner*—Harold D. Whitehead
*Attorney, Agent, or Firm*—Hopgood, Calimafde, Kalil, Blaustein & Judlowe

[57] ABSTRACT

A novel method and apparatus are provided by the invention for the precision-control of the thickness of thin work pieces under lapping in a lapping machine having an upper and lower lapping surface plates rotatable relative to each other sandwiching the work pieces with continuous supply of a lapping fluid therebetween. In the invention, the upper lapping surface place is provided with an opening in the lapping surface, in which an ultrasonic transducer means is mounted capable of projecting an ultrasonic wave to the work piece and receiving the dual echo waves reflected at the upper and the lower surface of the work piece so as that the delay time of the echo waves is transmitted as electrical signals to a control means of the lapping machine where the signals are computed in terms of the thickness of the work pieces and utilized for controlling the operation of the machine. The space between the ultrasonic transducer means and the work piece is filled with the lapping fluid so that any errors in the propagation of the ultrasonic waves can be minimized.

5 Claims, 3 Drawing Figures

METHOD OF ULTRASONIC CONTROL FOR LAPPING AND AN APPARATUS THEREFOR

BACKGROUND OF THE INVENTION

The present invention relates to a method for lapping a thin disc-like or plate-like material and an apparatus used therefor or, more particularly, to a method for lapping a thin material using a lapping machine provided with an upper and a lower lapping surface plates rotating relative to each other with the work piece sandwiched therebetween and an improved lapping machine for practicing the method with which in-process determination and control of the thickness of the work piece under lapping can be readily performed.

It is a usual process for precision-lapping of a thin disc-like or plate-like material, e.g. semiconductor silicon wafers, that the work piece is sandwiched as supported by a carrier between an upper lapping surface plate and a substantially parallel lower lapping surface plate of a lapping machine rotating relative to each other with continuous supply of a lapping fluid containing fine particles of an abrasive material until desired exactness of the surfaces of the work piece is obtained.

With the recent progress in the electronics or other fine technologies, it is sometimes required that the thickness of lapped materials is controlled with very high accuracy with an error of $1\times10^{-3}$ mm or smaller. The most simple but reliable way for the determination of the thickness of the work pieces under lapping is so-called out-of-process methods in which the lapping machine is periodically interrupted and the work pieces under lapping are taken out of the machine to have the thickness measured by a conventional measuring means. This method is, of course, very troublesome or time-consuming and undesirable from the standpoint of working efficiency.

Accordingly, there have been made several attempts to develop a method for the in-process determination of the thickness of work pieces under lapping, in which measurement of the thickness can be carried out without interrupting the operation of the lapping machine (see, for example, Japanese Utility Model Publication 41-24476). One of the problems in these prior art methods for the in-process thickness determination is that what is measured by the method is not the thickness of the work piece under lapping itself but the distance between the surfaces of the upper and the lower lapping surface plates. Therefore, large errors are sometimes unavoidable in the thickness determination due to the wearing or other irregularities in the plate surfaces and the intervention of the abrasive particles between the work piece and the plate surfaces. These errors are, in particular, relatively large when the thickness of the work piece under lapping is small, for example, 2 mm or smaller. Thus, no satisfactory method for the in-process determination of the thickness of work pieces under lapping has yet been developed and most of the conventional lapping processes utilize a mere timer with which a predetermined lapping time is set for interrupting the operation of the lapping machine.

SUMMARY OF THE INVENTION

It is therefore an object of the present invention to provide a novel method for lapping a thin work piece in which in-process thickness determination of the work piece can be performed by directly measuring the thickness of the work piece per se without interrupting the operation of the lapping machine so as that the problems in the above described prior art methods are solved.

Another object of the present invention is to provide an improved lapping machine provided with a means for in-process thickness determination of the work pieces under lapping without interruption of the machine.

Thus, the method of the invention for lapping a thin work piece comprises, in a lapping process of the thin work piece sandwiched as supported by a carrier between the annular lapping surfaces of an upper and a lower lapping plates rotating relative to each other with continuous supply of a lapping fluid to the interspace therebetween, projecting an ultrasonic wave substantially perpendicularly to the surface of the work piece through an opening provided in the annular lapping surface of the upper lapping plate with an ultrasonic transducer means, receiving the echo waves of the ultrasonic wave reflected at the upper and the lower surfaces of the work piece with the ultrasonic transducer means, and transmitting the electric signals produced in the ultrasonic transducer means corresponding to the time delay of the echo waves to a control means for the lapping machine as computed in terms of the thickness of the work piece.

The lapping machine of the invention for practicing the above method comprises (a) a lower lapping surface plate having an annular lapping surface, (b) an upper lapping surface plate having an annular lapping surface and capable of rotating relative to and substantially in parallel with the lower lapping surface plate sandwiching a thin work piece as held by a carrier between the annular lapping surfaces of the lower and the upper lapping surface plates, said upper lapping surface plate being provided with an opening in the annular lapping surface, (c) a means for projecting an ultrasonic wave to the work piece sandwiched between the lower and the upper lapping surface plates through the opening in the upper lapping surface plate, (d) a transducer means for receiving the echo waves of the ultrasonic wave reflected at the upper and lower surfaces of the work piece and generating an electric signal corresponding thereto, and (e) a control means of the lapping machine operated by the electric signal generated in said transducer means as computed in terms of the thickness of the work piece.

DETAILED DESCRIPTION OF THE PREFERRED EMBODIMENTS

Figure 1:
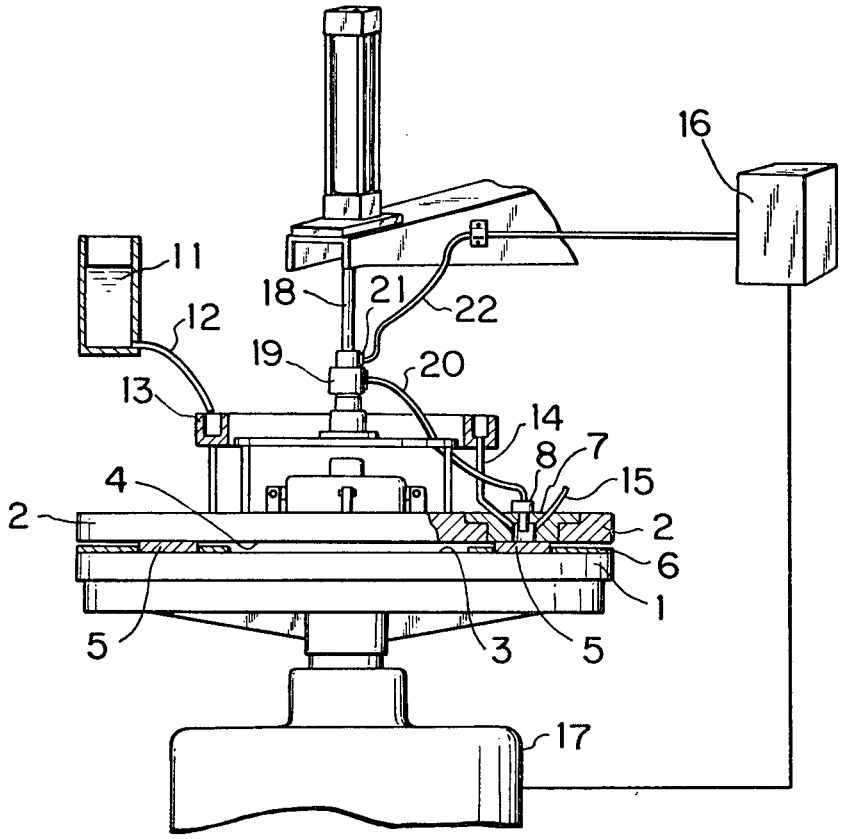
FIG. 1 is an elevational view of the lapping machine of the invention partially cut open to show the cross section with addition of the control means and the driving means as blocks.

The method and the lapping machine of the present invention are now described in detail with reference to the drawing annexed.

In FIG. 1 illustrating a schematic elevational view of the lapping machine partially cut open to show the cross section, the lower lapping surface plate 1 and the upper lapping surface plate 2 each have an annular lapping surface 3 or 4 facing each other and at least one or, usually, a plurality of work pieces 5 in the form of a thin disc or plate as held by a carrier 6 is sandwiched between these annular lapping surfaces 3 and 4 with an appropriate pressure. The lower lapping surface plate 1 and the upper lapping surface plate 2 can rotate substantially in parallel with and relative to each other while a lapping fluid containing fine particles of an abrasive material is continuously supplied to the interspace between the annular lapping surfaces 3 and 4 so that precision lap finish of the surfaces of the work piece 5 can be achieved. The assembly of the lapping surface plates 1 and 2 and the principle of lapping as described above are well known in the art and need not be described in further detail.

Figure 2:
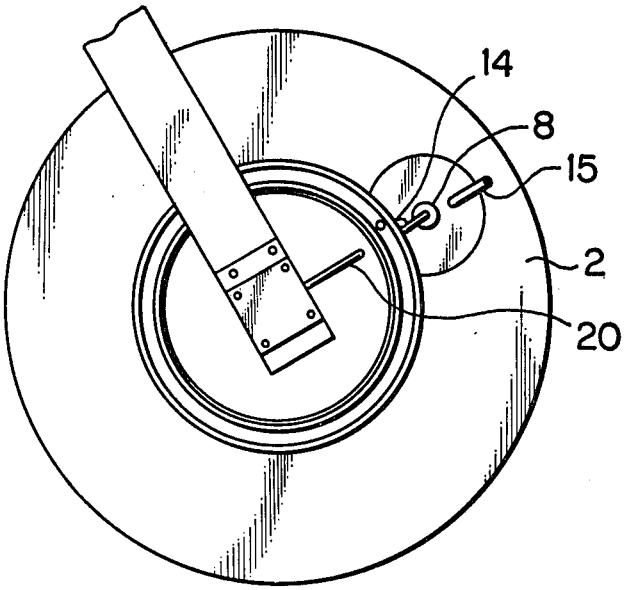
FIG. 2 is a plan view of the lapping machine.
Figure 3:
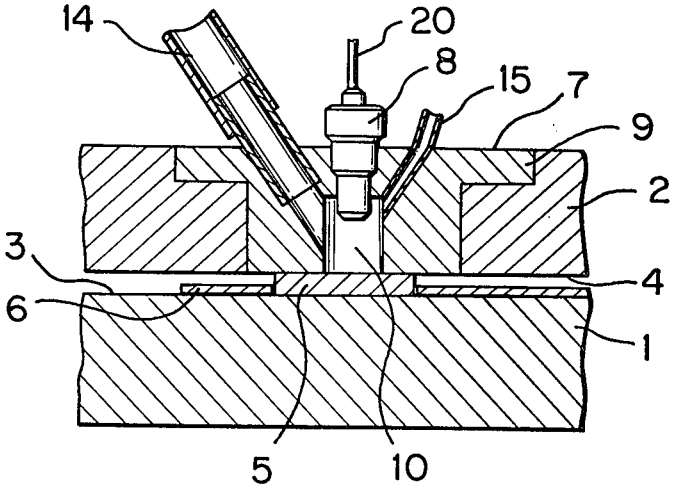
FIG. 3 is an enlarged cross sectional view of the lapping machine in the portion of the annular lapping surfaces.

In the inventive lapping machine, the upper lapping surface plate 2 is provided with one or more of openings 7 in the annular lapping surface 4. The radial position of the opening 7 is preferably at around the center portion of the width of the annular lapping surface 3 as shown in FIG. 2. The ultrasonic transducer means 8 is mounted in the opening 7 as supported by the cylindrical holder 9 as is shown in FIG. 3 illustrating an enlarged cross sectional view of the lapping surface plates 1 and 2 in the portion of the annular lapping surfaces 3 and 4. Thus, the ultrasonic transducer means can project an ultrasonic wave to the work piece 5 substantially perpendicularly through the cavity 10 in the opening 7. The electric power supply for the ultrasonic transducer means 8 is obtained with a battery (not shown in the figures) built in the unit of the transducer means 8. The technique converting the electric power to the ultrasonic wave is well established in the art utilizing a piezoelectric material. The frequency of the ultrasonic wave is not particularly limitative but preferable frequency is in the range from 1 to 50 MHz or, preferably from 5 to 30 MHz. Lower ultrasonic frequencies are undesirable due to the increased error in thickness determination caused in dependency on the condition of the lapping fluid filling the space between the ultrasonic transducer means and the work piece while larger frequencies bring about some difficulties in generating ultrasonic waves.

It is optional that the ultrasonic transducer means 8 is not fixed in the opening 7 in the upper lapping surface plate 2 so as to rotate together with the plate 2 but it may be positioned above the upper lapping surface plate 2 and projects the ultrasonic wave as pulses when the opening 7 in the rotating table 2 comes just below it. However, the above described built-in mounting in the opening 7 is recommended, the reason for which will be clear from the description below. The distance from the ultrasonic transducer means 8 to the upper surface of the work piece 5 is preferably as small as possible but it is usually in the range from 2 to 5 mm.

As is stated before, a lapping fluid containing fine particles of an abrasive material must be supplied continuously into the interspace between the lower and the upper lapping surface plates 1 and 2 so that the surfaces of the work pieces 5 are always wet with the lapping fluid. When a layer of air is left in the gap between the ultrasonic transducer means 8 and the upper surface of the work piece 5, the condition of wetting may be irregularly varied to cause an error in the propagation of the ultrasonic waves. In the present invention, this problem is avoided by filling the interspace between the ultrasonic transducer means 8 and the upper surface of the work piece 5 with the lapping fluid where no air is left therebetween. The lapping fluid kept in the holder tank 11 is led through a piping 12 into an annular duct or trough duct 13 from where the fluid further flows down through the piping 14 into the cavity 10 to leak into the interspace between the lower and the upper lapping surface plates 1 and 2. In order to ensure smooth flowing down of the lapping fluid from the annular duct 13 to the cavity 10, an air escape 15 is provided in the cylindrical holder 9 so as that good stability in the propagation of the ultrasonic wave is obtained. It is recommendable that a means is provided for adjusting the vertical position of the transducer means 8 relative to the upper lapping surface plate 2 in compensation for the wearing of the plate 2 so as to keep constant distance between the transducer means 8 and the upper surface of the work piece 5.

The ultrasonic wave projected to the work piece 5 substantially perpendicularly through the lapping fluid is reflected partly first at the upper surface of the work piece 5 while partly propagates in the work piece 5 to be reflected at the lower surface of the work piece 5 to produce dual echo waves with a time delay which propagate through the lapping fluid substantially perpendicularly to the surface of the work piece 5 back to the transducer means where the echo waves are converted to electric signals. The delay time in the dual echo waves depends on the material and the thickness of the work piece 5 but it is usually in the range from 0.05 to 0.5 microseconds.

It should be noted that the ultrasonic transducer means 8 receives not only the dual echo waves reflected on the upper and lower surfaces of the work piece 5 but also the multiple echo waves produced by the repeated reflection of the ultrasonic wave inside the body of the work piece 5. Accordingly, the record of the intensity of the ultrasonic wave received by the ultrasonic transducer means 8 as a function of time taken by means of, for example, an oscilloscope exhibits gradually attenuating pulses at regular intervals. It is readily understood that the time interval between any pair of adjacent or successive two pulses is directly proportional to the thickness of the work piece 5 according to the equation $$t = \tfrac{1}{2}\tau v,$$

where t is the thickness of the work piece 5 in m, $\tau$ is the time interval between adjacent two pulses in seconds and v is the velocity of the ultrasonic wave in the work piece 5 in m/second.

The electric signals corresponding to the echo waves of the ultrasonic wave produced in the transducer means 8 are then transmitted to the control means 16 for the lapping machine located in a separated position, in which the delay time in the echo waves is computed in terms of the thickness of the work piece 5 under lapping and, when the thickness of the work piece 5 has reached the predetermined value exactly, the driving means 17 of the machine is directed that the operation of the lapping machine is interrupted automatically.

The transmission of the electric signals from the transducer means 8 to the control means 16 can be carried out in several different ways. One of the methods is a so-called telemetering, that is, the unit of the ultrasonic transducer means 8 emits a radio wave modulated with the electric signals corresponding to the dual echo waves of the ultrasonic by means of a suitable electronic circuit and the signals received in the control means 16 are computed and utilized for the control of the driving means 17.

Another method for transmitting the electric signals from the transducer means 8 mounted on the rotating plate 2 to the stationary control means 16 is the use of a slip ring and a brush. Thus, the transducer means 8 is electrically connected to the slip ring 19 on the hanging shaft 18 of the table 2 with a coaxial cable 20 and the slip ring 19 is contacted with a brush 21 which in turn is connected electrically to the control means 16 with another coaxial cable 22 so that the electric signals are transmitted from the transducer means 8 to the control means 16 through the slipping contact between the slip ring 19 and the brush 21.

As is clear from the above description, the advantages obtained by the inventive method and lapping machine are as follows.

(1) A means for the direct in-process measurement of the thickness of the work piece under lapping is provided, which has been considered impossible in the prior art.

(2) Any errors in the propagation of the ultrasonic wave can be avoided because the propagation medium of the ultrasonic in the invention is the lapping fluid per se without the problem of abnormal contact of a delay material with the surface of the work piece.

(3) The in-process computerization of the electric signals corresponding to the delay time of the echo waves facilitates very efficient control of the thickness of the work pieces with an accuracy of $1\times10^{-3}$ mm or less in error.

Following is an example to illustrate the present invention in further detail but not to limit the scope of the invention by any means.

EXAMPLE

Lapping of blue plate glass of about 0.5 mm in thickness was undertaken with the lapping machine as shown in FIGS. 1 to 3, in which 24 pieces of the glass plate were simultaneously mounted on the machine and the automatic control means was set to interrupt the operation of the machine when the average value of the thickness of the 24 plates had reached 500 μm. After the end of the lapping in this manner, the lapped plates were taken out of the machine and the thickness of each of the plates was determined with a micrometer at 5 points for each of the plates and the values of the thickness for the 24 plates were averaged to give the average thickness for the lot as expressed in μm unit.

The above lapping procedure and determination of the average thickness for the lot was repeated with 20 lots of the glass plates and the deviation from the setting of 500 μm was recorded to find that the value was exactly 500 μm for 11 lots with −1 μm deviation (499 μm) for 3 lots and +1 μm deviation (501 μm) for 6 lots.

For comparison, similar lapping test was undertaken by a conventional timer control instead of the ultrasonic control as described above. The average values of the thickness for the 20 lots ranged from 490 to 510 μm in such a manner that the values were 490, 494, 495, 497, 502, 504, 507, 508 and 510 μm each for one lot and 496, 498, 500, 501 and 505 μm each for 2 lots.

What is claimed is:

1. A method for lapping a thin work piece in a lapping machine having a lower lapping surface plate with an annular lapping surface and an upper lapping surface plate with an annular lapping surface rotating relative to and substantially in parallel with the lower lapping surface plate with said work piece sandwiched therebetween and with a continuous supply of a lapping fluid to the interspace therebetween, which method comprises:

(a) projecting an ultrasonic wave substantially perpendicularly to the surface of the work piece through said lapping fluid and said work piece, said wave passing through an opening provided in a portion of the annular lapping surface of the upper lapping surface plate with an ultrasonic transducer means, (b) receiving the echo waves of the ultrasonic wave reflected at the upper and the lower surfaces of the work piece with the ultrasonic transducer means whereby the echo waves are converted into electric signals corresponding thereto, and (c) transmitting the electric signals to a control means for the lapping machine where the electric signals corresponding to the delay time of the echo waves are computed in terms of the thickness of the work piece and utilized for controlling the operation of the lapping machine.

2. The method as claimed in claim 1 wherein the electric signals are transmitted from the ultrasonic transducer means to the control means through a slip ring and a brush.

3. A lapping machine for lapping thin work pieces which comprises:

(a) a lower lapping surface plate having an annular lapping surface, (b) an upper lapping surface plate having an annular lapping surface and capable of rotating relative to and substantially in parallel with the lower lapping surface plate as supported by a hanging shaft sandwiching a thin work piece as held by a carrier between the annular lapping surfaces of the lower and the upper lapping surface plates, said upper lapping surface plate being provided with an opening in the annular lapping surface, (c) an ultrasonic transducer means for projecting an ultrasonic wave to the work piece sandwiched between the lower and the upper lapping surface plates through the opening in the upper lapping surface plate in a direction substantially perpendicular to the surface of the work piece, (d) means for supplying a lapping fluid to fill the space between the ultrasonic transducer projecting means and the upper surface of the work piece sandwiched between the lower and the upper lapping surface plates, (e) an ultrasonic transducer means for receiving the echo waves of the ultrasonic wave reflected at the upper and the lower surfaces of the work piece and generating electric signals corresponding thereto, (f) a control means of the lapping machine operated by the electric signals generated in the second transducer means as computed in terms of the thickness of the work piece, and (g) a means for transmitting the electric signals from the ultrasonic transducer means to said control means.

4. The lapping machine as claimed in claim 3 wherein the means for transmitting the electric signals from the ultrasonic transducer means to the control means is provided with a slip ring mounted on the hanging shaft of the upper lapping surface plate and a brush in contact with the slip ring.

5. The lapping machine as claimed in claim 3 wherein the ultrasonic transducer means is mounted on a holder which is fixed in the opening in the upper lapping surface plate.

* * * * *